US005695090A

United States Patent [19]

Burdick

[11] Patent Number: 5,695,090

[45] Date of Patent: Dec. 9, 1997

[54] IMPACT RESISTANT INSULATING BOTTLE CONTAINER

[76] Inventor: Geoffrey C. Burdick, 219 Plymouth Rd., West Palm Beach, Fla. 33405

[21] Appl. No.: 747,997

[22] Filed: Nov. 12, 1996

Related U.S. Application Data

[63] Continuation of Ser. No. 445,757, May 22, 1995, abandoned.

[51] Int. Cl.[6] ..... B65D 23/08; B65D 25/26

[52] U.S. Cl. ..... 220/739; 53/449; 29/450; 29/525; 206/521; 215/12.1

[58] Field of Search ..... 220/737, 739, 220/740, 902, 903; 206/521, 524.2, 592, 523, 527; 215/395, 400, 247, 12.1, 12.2, 13.1; 53/139.5, 472, 173, 449; 29/450, 521

[56] References Cited

U.S. PATENT DOCUMENTS

| | | | |
|---|---|---|---|
| D. 306,800 | 3/1990 | Yeager | D3/100 |
| D. 339,034 | 9/1993 | Walcott et al. | D7/607 |
| D. 343,765 | 2/1994 | Khan | D7/605 |
| 2,729,259 | 1/1956 | Abrams | 220/903 X |
| 2,923,427 | 2/1960 | Klopfenstein | 215/247 X |
| 2,996,213 | 8/1961 | Mitchell et al. | 220/737 |
| 3,120,319 | 2/1964 | Buddrus | 206/523 X |
| 3,713,302 | 1/1973 | Reviel | 62/3 |
| 3,779,298 | 12/1973 | Piccirilli et al. | 206/523 X |
| 3,819,081 | 6/1974 | Runte | 206/521 X |
| 3,942,667 | 3/1976 | Thomas | 215/12.1 |
| 3,968,871 | 7/1976 | Briscoe | 206/1.5 |
| 4,054,208 | 10/1977 | Lowe | 206/537 |
| 4,114,759 | 9/1978 | Maloney, Jr. | 206/523 X |
| 4,227,615 | 10/1980 | Flick | 215/222 |
| 4,343,158 | 8/1982 | Campbell | 62/372 |
| 4,371,087 | 2/1983 | Saujet | 215/395 X |
| 4,383,422 | 5/1983 | Gordon et al. | 62/457 |
| 4,462,444 | 7/1984 | Larson . | |
| 4,620,426 | 11/1986 | Pitchford et al. | 62/457 |
| 4,733,807 | 3/1988 | Porter et al. | 224/202 |
| 4,738,364 | 4/1988 | Yeager | 206/563 |
| 4,746,028 | 5/1988 | Bagg . | |
| 4,793,149 | 12/1988 | Riche | 62/293 |
| 4,802,602 | 2/1989 | Evans et al. . | |
| 4,813,558 | 3/1989 | Fujiyoshi | 220/903 X |
| 4,890,764 | 1/1990 | Rossini | 206/524.2 |
| 4,915,255 | 4/1990 | Curtis | 206/521 X |
| 4,946,038 | 8/1990 | Eaton | 206/528 |
| 5,011,019 | 4/1991 | Satoh et al. | 206/530 |
| 5,186,350 | 2/1993 | McBride | 220/412 |
| 5,261,554 | 11/1993 | Forbes | 220/412 |
| 5,277,733 | 1/1994 | Effertz | 156/215 |
| 5,325,988 | 7/1994 | Ekern | 220/411 |
| 5,361,604 | 11/1994 | Pier et al. | 62/457.4 |
| 5,390,791 | 2/1995 | Yeager | 206/438 |
| 5,425,470 | 6/1995 | Duhaime et al. | 206/524.2 |
| 5,429,263 | 7/1995 | Haubenwallner | 215/400 X |

FOREIGN PATENT DOCUMENTS

| | | | |
|---|---|---|---|
| 345174 | 12/1989 | European Pat. Off. | 215/384 |

*Primary Examiner*—Allan N. Shoap
*Assistant Examiner*—Christopher J. McDonald
*Attorney, Agent, or Firm*—John C. Smith

[57] ABSTRACT

A removable insulating container which grips a bottle such that the container is held snugly in place. The container uses a separate lower sleeve and an upper cap which are mounted on a medicine bottle to substantially encase the medicine bottle. The container is fabricated from a multi-layer flexible material which has an impact resistant outer layer and an inner layer which forms an internal channel that grips the side of the medicine bottle. The proximal end of the container has an optional viewing window which allows the user to estimate the amount of medicine remaining in the medicine bottle. The proximal end of the lower sleeve extends past the bottom of the bottle to prevent it from impacting a surface should it be dropped. In addition to holding the upper cap on the medicine bottle through the gripping action of the inner layer, the upper cap can optionally be formed with a compressible flexible barrier on the distal end creating vacuum chamber which can be used to hold the upper cap in place with vacuum pressure. The container walls can be colored to prevent light from penetrating the medicine bottle.

16 Claims, 5 Drawing Sheets

IMPACT RESISTANT INSULATING BOTTLE CONTAINER

This is a continuation of application Ser. No. 08/445,757 filed on May 22, 1995, now abandoned.

BACKGROUND OF THE INVENTION

1. Technical Field

The present invention relates to containers. In particular, it relates to portable containers for medicine bottles which provide high impact protection and insulation.

2. Background Art

Currently, there are millions of individuals who are required to take injections of medicine for a variety of medical problems such as allergies, diabetes, etc. While any liquid medicine can be securely transported by the container disclosed herein, a large segment of the population is comprised of diabetics who require insulin injections on a daily basis. Therefore, for ease of discussion, the container will be discussed in terms of its use by an ordinary diabetic.

Due to the deterioration over time of liquid medicines such as insulin, diabetics typically keep small bottles of insulin. These bottles can vary in size and capacity, but typically are approximately 2 inches high by ⅞ inches wide. However, even at such a small size, the cost of the insulin can be significant. A problem associated with these bottles is their fragility. Since a diabetic must have access to insulin at specific times of the day, the ability of a diabetic to transport the insulin when traveling is vital if the diabetic is to be able to leave home at convenient times.

A significant drawback to carrying insulin is the susceptibility to damage due to undesirable thermal conditions. If the insulin bottle is exposed to heat while traveling in an automobile, the insulin will deteriorate at a faster rate than it would if refrigerated. The prior art has addressed this problem in several ways. It is known to transport insulin in electrically powered refrigerated containers. While providing a stable environment for the insulin, a significant drawback to this approach is the bulk and weight of the device which prevents convenient carrying for short trips. Likewise, the purchase cost associated with this device along with the cost of maintenance create disadvantages to its use. It would be advantageous to have a lightweight, compact device which could be used to transport insulin.

Another approach has been the use of storage devices which contain refrigerants such as "Blue Ice" or like materials. While this approach is less expensive than the previously discussed devices, it also has disadvantages. The bulk required for the compartments holding the cooling material does not permit convenient carrying (for example, in a pocket). Further, condensation can be a problem with these devices since the condensed air moisture will cause the user's clothing to get wet if held closely. As was the case above, it would be desirable to have a lightweight, compact device for transporting insulin which could be conveniently carried in the pocket or purse of a diabetic.

In addition to the issue of temperature control, weight and bulk, there is another equally important issue related to the transportation of liquid medicine. Namely, the expense associated with inadvertent breakage of the medicine bottle. As discussed above, even small bottles such as those used by diabetics are expensive and the accidental breakage of a bottle either while traveling or at home can create a burden for the diabetic.

It is known in the prior art to transport a medicine bottle in a cooler-type carrier which provides insulation and protection. The disadvantage to this type of device is the bulk and weight which makes the device unusable for short trips during the day. Again, it would be desirable to have the ability to transport medicine bottles in a device which could provide insulation and impact resistance while at the same time providing the convenience of a lightweight, compact pocket sized container which could be taken on day trips.

The foregoing discussion has centered on devices which are used for transport of medicine bottles. However, even if the medicine bottles are kept at home, it would still be desirable to have a compact container which provides insulation, and more important, impact resistance to avoid breakage. Still further, it would be desirable to avoid the costs and size disadvantages related to prior art devices.

Those skilled in the art will recognize that the same uses, reasoning and benefits apply to any type of liquid medicine, not just insulin. Further, the invention can also be effectively used with non-liquid medicines such as pills, powders, etc., since glass bottles can also be used for these preparations.

The prior art has failed to provide a low cost, highly compact and lightweight container which provides both impact resistance and insulation for liquid medicines in particular, and any fragile glass or glass substitute medicine containers in general.

SUMMARY OF THE INVENTION

The present invention solves the foregoing problems by providing a removable insulating container which grips a medicine bottle such that the container is held snugly in place. The container has a separate lower sleeve and upper cap which are mounted on a medicine bottle to substantially encase the medicine bottle during transport. The container is fabricated from a multi-layer flexible material which has an impact resistant outer layer and an inner layer which forms an internal channel that grips the side of the medicine bottle. The proximal end of the container has an optional viewing window which allows the user to estimate the amount of medicine remaining in the medicine bottle. The proximal end of the lower sleeve extends past the bottom of the bottle to prevent it from impacting a surface should it be dropped. In addition to holding the upper cap on the medicine bottle through the gripping action of the inner layer, the upper cap can optionally be formed with a compressible flexible barrier on the distal end such that an airtight pocket is created which forms a vacuum chamber to hold the upper cap in place. The container walls are opaque and can be colored for esthetic reasons or to limit light from penetrating the medicine bottle.

DESCRIPTION OF THE PREFERRED EMBODIMENT

Figure 1:
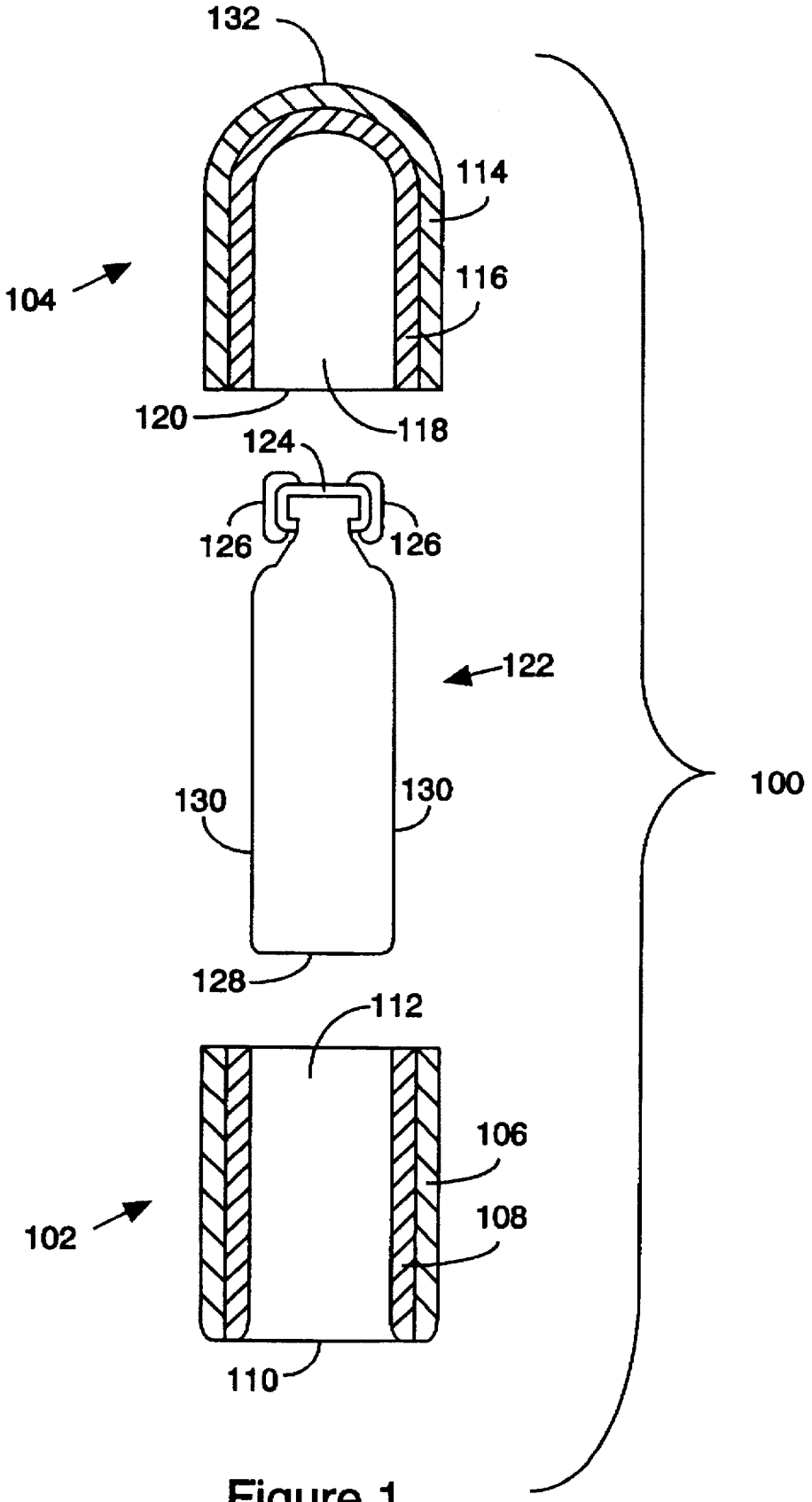
FIG. 1 is a diagram showing a cutaway side view of the lower sleeve and upper cap of the invention prior to being mounted on a medicine bottle.

Referring to FIG. 1, which is a cutaway side view of the lower sleeve 102 and upper cap 104 of the container 100 is illustrated. Medicine bottle 122 is also shown. In the preferred embodiment, lower sleeve 102 has a multi-layer impact resistant wall 106, 108. Wall 106, 108 has an inner layer 108 which forms a gripping surface. In the preferred embodiment, inner layer 108 is harder than outer layer 106. Inner layer 108 provides structural support and protection for medicine bottle 122. In addition, the inner layer 108 also has a non-slip gripping surface which inhibits movement of the lower sleeve 106, 108 once it is mounted on medicine bottle 122. Outer layer 106 is more flexible the inner layer 108 and provides more impact resistance. The outer layer 106 also has a non-slip surface designed to avoid inadvertant slippage when held in the users hand.

Lower sleeve 106, 108 has an internal channel 112 which is sized such that medicine bottle 122 can be slidably inserted into internal channel 112, but also sized such that medicine bottle 122 is firmly gripped under pressure from the inside wall of lower sleeve 102 and further held by the non-slip surface of inner layer 108. Aperture 110 at the proximal end of lower sleeve 102 forms a viewing window which allows the contents of the medicine bottle to be seen so that the user can estimate the remaining amount of medicine available.

Medicine bottle 122 is a prior art syringe type medicine bottle which has a bottom 128, a side wall 130, a seal 124 capable of penetration by a syringe needle, and a seal cap 126.

The upper cap 104 has the same multi-layer structure as lower sleeve 102. Upper cap 104 has inner layer 116 and outer layer 114 which correspond to lower sleeve 102 layers 108, 106 respectively. Aperture 120 allows access to internal channel 118 by medicine bottle 122 when upper cap 104 is mounted on medicine bottle 122. In the preferred embodiment, the upper cap 104 does not have an opening at the distal end 132. However, those skilled in the art will recognize that aperture 110 of lower sleeve 102 can be sealed and an optional alternative aperture placed at the distal end 132 of upper cap 104. If the upper cap 104 had an aperture it would allow for easy access to the seal 124 of medicine bottle 122. However, the vacuum chamber 302 (discussed below in regard to FIG. 3) would be lost and the actual viewing area would not be as good as that provided in the preferred embodiment.

The materials used to fabricate the container 100 in the preferred embodiment are a two layer foam and vinyl plastisol structure made with the vinyl dip molding process. The material is commercially available under the "Tuffoam" trade name from Sinclair and Rush, Inc. in St. Louis, Mo. The outer layer 106, 114 is a flexible impact resistant foam approximately ⅛ inches thick. The vinyl inner layer 108, 116 is approximately 1/16 to ⅛ inches thick. The foregoing thicknesses were selected for a small syringe type medicine bottle 122 measuring approximately ⅞ inches in diameter.

A particular advantage associated with the use of a vinyl plastisol inner layer 108 is the substantially air tight seal which the inner layer 108 makes with the glass surface of the medicine bottle 122. The air tight seal provides a snug grip between the medicine bottle 102 and the lower sleeve 102 and upper cap 104. In addition, the air tight seal enables the further advantage of the vacuum chamber 132, discussed more fully below, which would not be as effective with materials that permit greater air penetration.

Those skilled in the art will recognize that the thickness selected for the inner and outer layers 106, 108, 114, 116 will vary based on the size and weight of the medicine bottle 122 which is to be protected. The thicknesses selected are not critical so long as sufficient impact protection is provided. In addition, any suitable materials can be used providing the gripping ability is sufficient to hold the container to the bottle and the insulating properties are sufficient.

Figure 2:
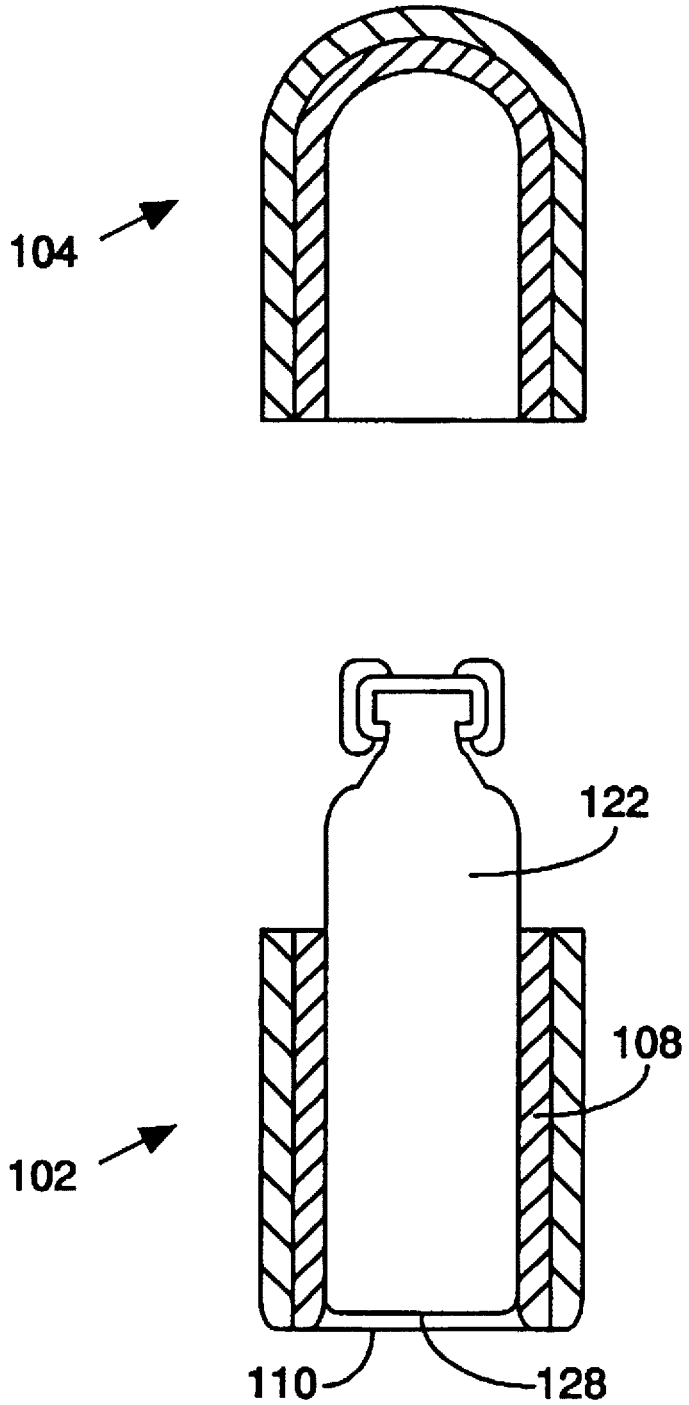
FIG. 2 shows a cutaway side view of the lower sleeve mounted on a medicine bottle with the upper cap not yet mounted.

In FIG. 2 shows a cutaway side view of lower sleeve 102 mounted on a medicine bottle 122 with upper cap 104 not yet mounted. As can be seen, medicine bottle 122 fits snugly within the internal channel 112 of lower sleeve 102. In the preferred embodiment, the medicine bottle 122 is inserted within internal channel 112 such that the bottom 128 of medicine bottle 122 does not reach the proximal end 110 of lower sleeve 102. By mounting lower sleeve 102 in this fashion. More specifically by extending the proximal end 110 past the bottom 128 of medicine bottle 122, a recessed area is formed between the bottom 128 of medicine bottle 122 which prevents the bottom 128 of the medicine bottle 122 from contacting an impact surface should the container be inadvertantly dropped.

A subtle feature of the design in the preferred embodiment is the difference in the length of the side wall 130 of medicine bottle 122 which is gripped by lower sleeve 102 as opposed to the length of the side wall 130 of medicine bottle 122 which is gripped by upper cap 104. By providing more area for lower sleeve 102 in relation to medicine bottle 122 than is available to upper cap 104, lower sleeve 102 will remain in postion when the container 100 is opened and upper cap 104 will come off more easily. Sufficient length should be available to provide adequate gripping by upper cap 104. In the preferred embodiment, approximately 1 and ¼ inches is provided for lower sleeve 102 while approximately ¼ inches is provided for upper cap 104. However, the exact amount allocated for lower sleeve 102 and upper cap 104 is not critical and may vary.

Figure 3:
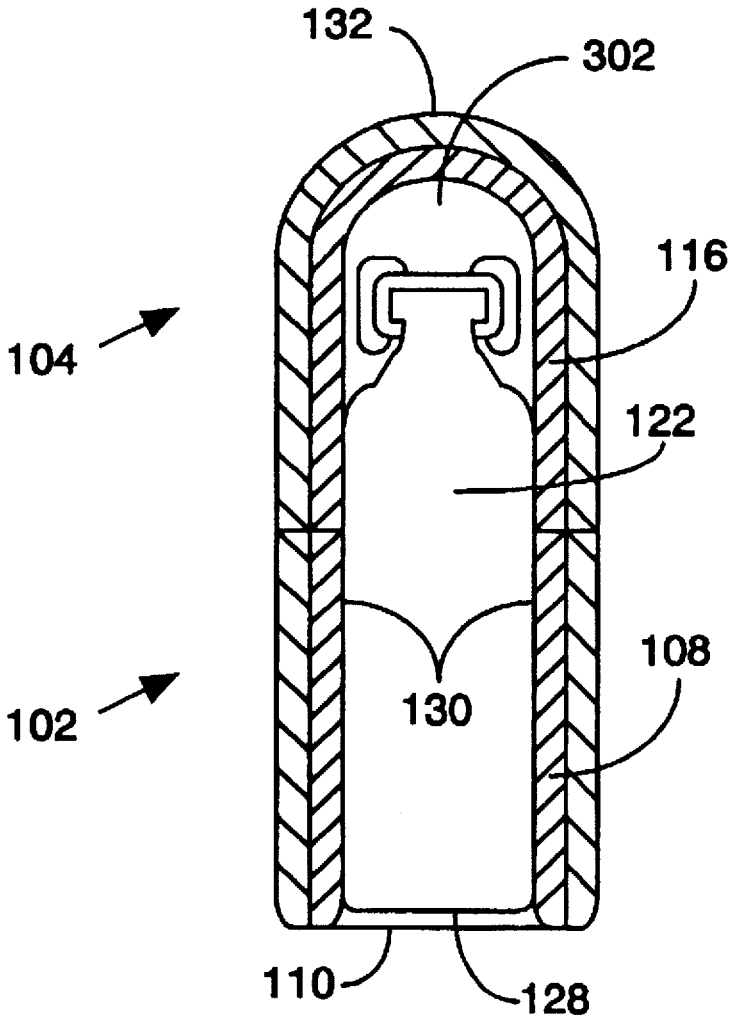
FIG. 3 is a cutaway side view of the lower sleeve and upper cap mounted on a medicine bottle which is encapsulated. The viewing window and vacuum chamber are also shown.

FIG. 3 illustrates an assembled container 100 with lower sleeve 102 and upper cap 104 mounted on a medicine bottle 122. In this figure, medicine bottle 122 is completely encapsulated. The viewing window created by aperture 110 is shown along with the recessed area between the aperture 110 at the distal end of lower sleeve 102 and the bottom 128 of bottle 128. An advantage provided by the recessed area is that even though a portion of the medicine bottle 122 is exposed, it is protected from impact.

Tests of container 100 have revealed that not only does the device protect medicine bottles during simple dropping, but even more violent testing, such as throwing a medicine bottle 122 encapsulated in container 100 against walls has failed to damage the medicine bottle 122. As a result, a user can leave home with minimum concern that the user will be stranded without medicine due to accidental damage to the medicine bottle 122.

In addition, vacuum chamber 132 is also illustrated. When upper cap 104 is mounted on medicine bottle 122, the flexible distal end 132 of upper cap 104 can be compressed to push air from vacuum chamber 302. One the compressive force on the outside of upper cap 104 is released, the natural flexing of distal end 132 of upper cap 104 acts to create a slight vacuum which further helps secure upper cap 104 to medicine bottle 122.

Another advantage of container 100 is the insulating effect of lower sleeve 102 and upper cap 104. By encapsulating substantially all of medicine bottle 122 (assuming aperture 110 is provided) a significant amount of insulation is provided which in turn creates a more stable environment for the medicine.

Further, the advantages of container 100 are achieved in a container 100 which is barely larger than the medicine bottle it holds. As a result, the user can very conveniently carry the medicine bottle 122 and container 100 in a pocket, purse, etc.

Figure 4:
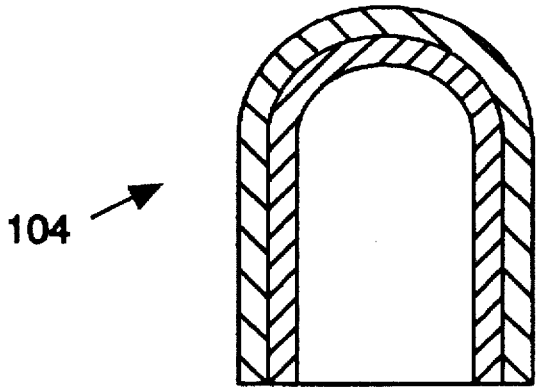
FIG. 4 shows a cutaway side view of the lower sleeve mounted on a medicine bottle with the upper cap not mounted. The plane formed between the lower sleeve and the cap of the medicine bottle is illustrated in relation to the shoulder of the medicine bottle.
Figure 4:
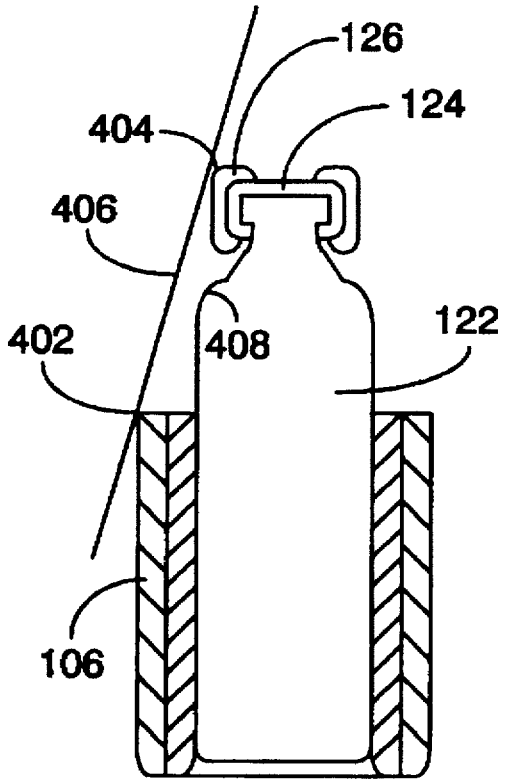

In FIG. 4, lower sleeve 102 is mounted on a medicine bottle with upper cap 104 removed. A design objective of container 100 is the avoidance of accidental damage to medicine bottle 122 should the container 100 be dropped while upper cap 104 is removed (as would be the case when the user is preparing an injection). A feature of syringe type medicine bottle 122 is the use of a rubber-like seal 124 which provides access for a syringe needle (not shown). The seal 124 is held in place by a metal ring 126. If medicine bottle 122 was dropped without lower sleeve 102 mounted on it, one possible cause of breakage is an impact on the glass surface at a weak point such as shoulder 408 of medicine bottle 122. Lower sleeve 102 is designed long enough and thick enough to prevent a glass surface such as shoulder 408 from impacting if medicine bottle 122 is dropped. The plane 406 formed between the outside distal edge 402 of lower sleeve 102 and the outer edge 404 of metal ring 126 of medicine bottle 122 is illustrated in relation to the shoulder 408 of the medicine bottle 122. As can be seen, the shoulder 408 is prevented from impacting due to the presence of lower sleeve 102 even though upper cap 104 is not presently mounted. An advantage of using ring 126 is that the presence of rubber-like seal 124 between ring 126 and the medicine bottle 122 glass has the effect of acting as a shock absorber to mimize the impact at edge 404. Likewise, the distal edge 402 also acts as a shock absorber such that the glass surface of shoulder 408 is protected from direct contact with the impacting surface no matter what position container 100 lands in.

Figure 5:
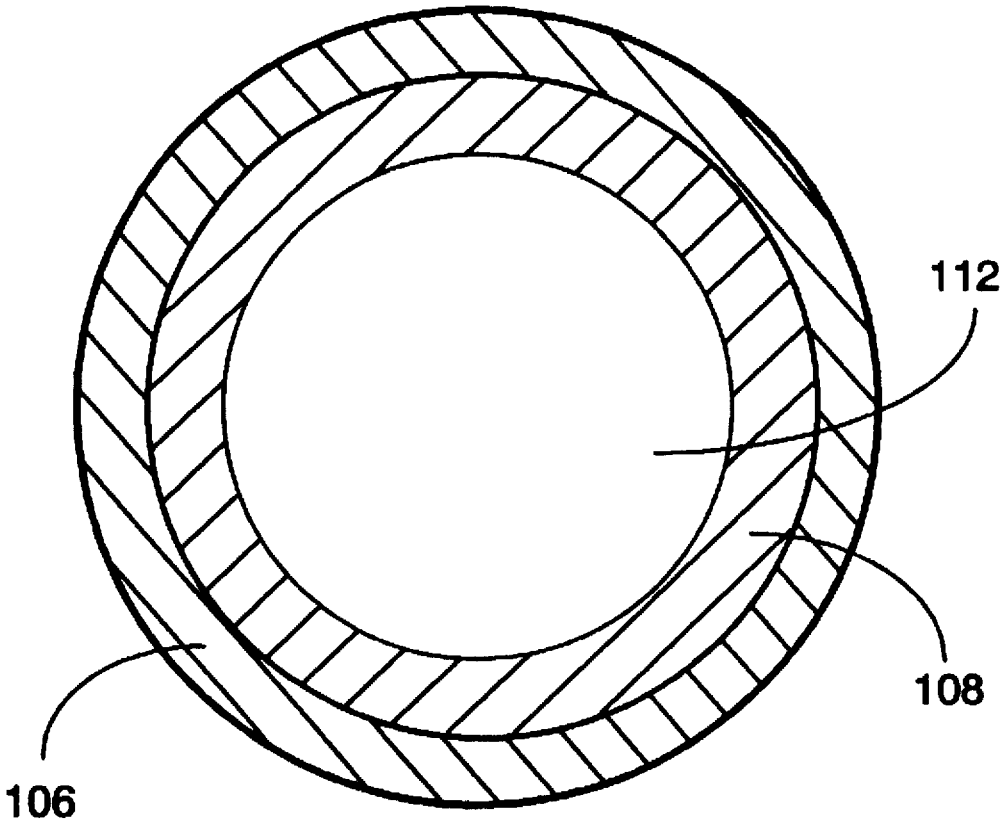
FIG. 5 shows a bottom view of the lower sleeve mounted on a medicine bottle. The viewing window formed by the aperture in the proximal end of the lower sleeve is illustrated in this figure.

FIG. 5 shows a bottom view of the lower sleeve 102. The viewing window is formed by the aperture 110 in the proximal end of the lower sleeve 102. From this view internal channel 112 can be seen along with inner layer 108 and outer layer 106.

Advantages of the container 100 include low cost, small size for convenience, easy viewing of medicine bottle contents, protection from damage to medicines from light, thermal insulation, and high impact resistance in both the fully encapsulated configuration as well as when the upper cap 104 is removed and only the lower sleeve 102 is mounted. In addition, the container 100 can be used for any type of syringe medicine bottle 122, for any other liquid medicine bottle, or for bottles holding pills or powdered medicines. As a result, users can carry insulin or other medicines with greater confidence and convenience.

For ease of discussion, smaller medicine bottles typically used by individuals were used in the discussion above. However, those skilled in the art will recognize that in other environments, such as hospitals, larger size medicine bottles may be used. The benefits and advantages associated with the use of container 100 apply equally to larger sized medicine bottles.

While the invention has been described with respect to a preferred embodiment thereof, it will be understood by those skilled in the art that various changes in detail my be made therein without departing from the spirit, scope, and teaching of the invention. For example, the material used to fabricate the container 100 can vary. The sizes used as well as the size of the bottle protected can vary. Any medicine, not just insulin, can be protected by container 100. Container 100 can be used for solid and powdered medicines as well as for liquid medicines, etc. Accordingly, the invention herein disclosed is to be limited only as specified in the following claims.

I claim:

1. An impact resistant medicine container system, the container system comprising:

a medicine bottle, the medicine bottle further comprising:

a rigid bottle having a bottle aperture for accessing its contents; and a cap assembly having a seal cap and a seal, the seal secured to the bottle aperture by the seal cap, the seal substantially sealing the bottle and suitable for penetration by a syringe; and a container, further comprising;

a lower sleeve having a substantially impact resistant wall which extends from a proximal end to a distal end, the lower sleeve farther having a first aperture in the distal end, the first aperture opening into a first internal channel with a diameter sufficiently wide to permit at least a portion of the medicine bottle to be removably inserted into the first internal channel and snugly gripped by the lower sleeve;

an upper cap having a substantially impact resistant wall which extends from a proximal end to a distal end, the upper cap further having a second aperture in the proximal end, the second aperture opening into a second internal channel with a diameter sufficiently wide to permit at least a portion of the upper cap to be removably mounted over and snugly grip the medicine bottle;

the impact resistant wall of the lower sleeve has sufficient thickness such that when the medicine bottle is inserted into the first internal channel, a plane extending from the outer surface of the distal end of the lower sleeve to the outer surface of the seal cap of the medicine bottle will not be broken by a surface of the medicine bottle, the lower sleeve and the seal cap preventing the surface of the medicine bottle from direct impact if the container system is dropped with the upper cap removed;

whereby direct impact to the surface of the medicine bottle is prevented even when the container system is dropped with the upper cap removed.

2. An system, as in claim 1, wherein:

the inner surface of the lower sleeve has a non-slip gripping surface which inhibits movement of the lower sleeve when mounted on the medicine bottle; and the internal channels of lower sleeve and upper sleeve having sufficient combined length to substantially encase the medicine bottle inserted therein such that if dropped on a flat surface, the medicine bottle would not be directly impacted.

3. A container system, as in claim 2, wherein the impact resistant wall of the lower sleeve and the seal of the medicine bottle acting as shock absorbers to cushion the impact of the container system when the container system is dropped.

4. A container system, as in claim 3, wherein:

the distal end of the upper cap forms a flexible barrier which is substantially airtight;

the impact resistant wall of the upper cap, when gripping the medicine bottle forms a substantially airtight seal;

the upper cap having sufficient length to form an air pocket when mounted on the medicine bottle; and the flexible barrier, if compressed when the upper cap is mounted on the medicine bottle, creates a vacuum pressure in the air pocket when the compressive force is released.

5. A container system, as in claim 4, further comprising a proximal aperture in the lower sleeve, the proximal aperture forming a viewing window for observing the internal channel of the lower sleeve;

whereby, the contents of the medicine bottle can be viewed while the medicine bottle inserted into the container.

6. A container system, as in claim 5, wherein the proximal end of the impact resistant wall of the lower sleeve is sufficiently long such that when mounted on the medicine bottle, the proximal end extends past the end of the medicine bottle to form a recessed area between the lower surface of the medicine bottle and the end of the container such that when the container is placed on a surface the lower surface of the medicine bottle is prevented from contacting the surface.

7. A container system, as in claim 6, wherein the lower sleeve and the upper cap are fabricated from insulating material.

8. A container system, as in claim 1, further comprising a proximal aperture in the lower sleeve, the proximal aperture forming a viewing window for observing the internal channel of the lower sleeve.

9. A method of preventing damage to syringe usable medicine bottles, the method including the steps of:

forming a lower sleeve having a substantially impact resistant wall which extends from a proximal end to a distal end, the lower sleeve further having a first aperture in the distal end, the first aperture opening into a first internal channel with a diameter sufficiently wide to permit at least a portion of a medicine bottle to be removably inserted into the first internal channel and snugly gripped by the lower sleeve;

mounting the lower sleeve on the bottom of a medicine bottle, the medicine bottle including a rigid bottle having a bottle aperture for accessing its contents, and a cap assembly having a seal cap and a seal, the seal secured to the bottle aperture by the seal cap, the seal substantially sealing the bottle and suitable for penetration by a syringe;

using an upper cap having a substantially impact resistant wall which extends from a proximal end to a distal end, the upper cap further having a second aperture in the proximal end, the second aperture opening into a second internal channel with a diameter sufficiently wide to permit at least a portion of the upper cap to be removably mounted over and snugly grip the top of the medicine bottle;

preventing the surface of the medicine bottle from direct impact if the container system is dropped with the upper cap removed by forming the impact resistant wall of the lower sleeve with sufficient thickness such that when a medicine bottle is inserted into the first internal channel, a plane extending from the outer surface of the distal end of the lower sleeve to the outer surface of the seal cap of the medicine bottle will not be broken by a surface of the medicine bottle, whereby direct impact to the surface of the medicine bottle is prevented even when the container system is dropped with the upper cap removed.

10. A method, as in claim 9, including the further steps of:

using a non-slip gripping surface on the inner surface of the lower sleeve to inhibit movement of the lower sleeve when it is mounted on the medicine bottle; and using lower sleeve and upper sleeves with sufficient combined length to substantially encase the medicine bottle inserted therein such that if dropped on a flat surface, the medicine bottle would not be directly impacted.

11. A method, as in claim 10, including the further step of using the impact resistant wall of the lower sleeve and the seal of the medicine bottle as shock absorbers to cushion the impact on the medicine bottle when the medicine bottle is dropped.

12. A method, as in claim 11, including the further steps of:

forming the distal end of the upper cap into a flexible barrier which is substantially airtight;

gripping the medicine bottle with the impact resistant wall of the upper cap such that a substantially airtight seal is formed;

providing the upper cap with sufficient length to form an air pocket when mounted on the medicine bottle; and compressing the upper cap when mounting the upper cap on the medicine bottle and creating a vacuum pressure in the air pocket when the compressive force is released.

13. A method, as in claim 12, including the further step of forming a viewing window in the lower sleeve for observing the contents of the medicine bottle.

14. A method, as in claim 12, including the further step of forming a recessed area between the lower surface of the medicine bottle and the end of the container by lengthening the proximal end of the impact resistant wall of the lower sleeve such that when mounted on the medicine bottle, .the proximal end extends past the end of the medicine bottle;

whereby the lower surface of the medicine bottle is prevented from contacting a surface when the container is placed on a surface.

15. A method, as in claim 12, including the further step of fabricating the lower sleeve and the upper cap from insulating material.

16. A method, as in claim 9, including the farther step of forming a viewing window in the lower sleeve for observing the contents of the medicine bottle.

* * * * *